United States Patent [19]

Rowland

[11] Patent Number: 4,606,086

[45] Date of Patent: Aug. 19, 1986

[54] LOUNGE CHAIR FOR READING

[76] Inventor: David B. Rowland, 1521 Woodcroft Dr., Raleigh, N.C. 27609

[21] Appl. No.: 747,330

[22] Filed: Jun. 21, 1985

[51] Int. Cl.[4] ..... A47C 17/64

[52] U.S. Cl. ..... 5/111; 5/431; 2/202; 297/452

[58] Field of Search ..... 5/111, 112, 114, 110, 5/431; 297/452, 378; 2/202, 204

[56] References Cited

U.S. PATENT DOCUMENTS

| | | | |
|---|---|---|---|
| 2,113,779 | 4/1938 | Williamson | 2/202 |
| 3,671,983 | 6/1972 | Bertolet | 5/114 |
| 3,897,102 | 7/1975 | Lemaire | 5/111 |
| 3,951,160 | 4/1976 | Nitu | 2/202 |

FOREIGN PATENT DOCUMENTS

| | | | |
|---|---|---|---|
| 2501986 | 9/1982 | France | 5/110 |

*Primary Examiner*—Alexander Grosz
*Attorney, Agent, or Firm*—William C. Lawton

[57] ABSTRACT

An improved lounge chair to support a person adjustable from a sitting to a prone position, the portion of said chair supporting the person's upper body having an opening provided therein large enough so that when a person's face is placed against the opening, the eyes, nose and mouth are unobstructed by any portion of the chair.

4 Claims, 3 Drawing Figures

LOUNGE CHAIR FOR READING

BACKGROUND OF THE INVENTION

This invention relates to an improved pool or beach lounge chair. More particularly the invenion relates to an improved construction in said chairs having an opening in the upper-body support portion thereof so that a user of the chair can place a book or magazine under the opening while placing his or her face over the opening so that the user can read in a comfortable prone position while laying prone on his or her stomach.

There has been little or no advance in the construction of said chairs over the past several years. Such chairs are formed from a lightweight frame of tubular aluminum. Various type of plastic or mesh cross straps are woven around the frames of these chairs to form the body support. The body support are also formed from a lightweight solid or mesh fabric stitched around the tubular frame portions. Except for slight design modifications in the method by which the upper body and the leg support portions move up or down or improvements in the plastics or fabrics forming the body support, these loungechairs as marketed over the years have remained unchanged in overall appearance or construction.

A common past-time for people who lounge in these chairs at beaches or pools is to read when sunning or relaxing in the chairs. To read when lying in these chairs as they are presently constructed is both difficult and uncomfortable. A user has to hang his or her head or shoulders over the top edge of the portion of said chair supporting the upper body. In such a position there is no support for the reader's head and thus prolonged reading is very difficult.

This invention provides an improvement in the construction of said chairs to make them enjoyable for reading while lying on your stomach and yet remain fully functional for all other uses to which the chairs have heretofore been put.

OBJECTS OF THE INVENTION

It is an object of the invention to provide a pool lounge chair of improved construction so that a user can lie on his or her stomach and comfortably read in said chair.

It is another object of the invention to provide a pool lounge chair with an opening in the portion supporting the user's upper body so that a user can lie on his or her stomach and place their face over the opening and read through the opening a book or magazine held or resting on the opposite side of the portion supporting the user.

Still further objects will become apparent from a reading of the specification and claims herein.

DETAILED DESCRIPTION OF THE INVENTION

Figure 1:
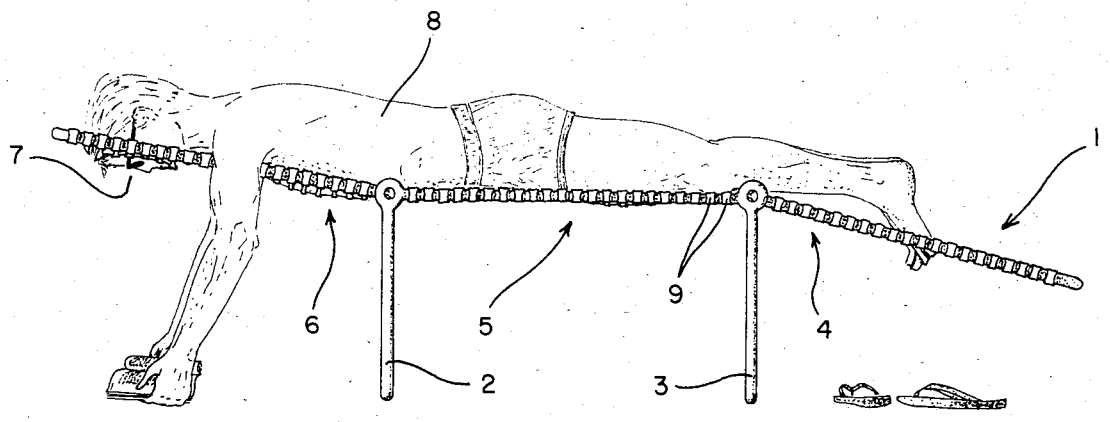
FIG. 1 is a side view of a pool lounge chair of the invention as it would be used by a person to read in a lying position.
Figure 2:
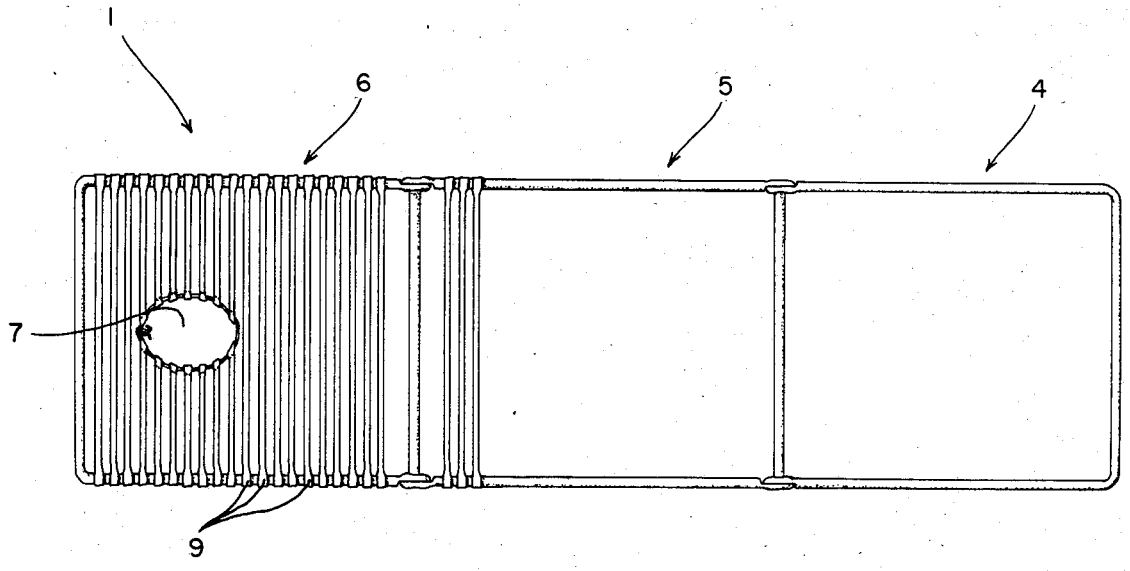
FIG. 2 is a top view of the pool lounge chair of the invention showing the frame, the upper body portion with cross-straps in place and the central portion with cross-straps partially in place.
Figure 3:
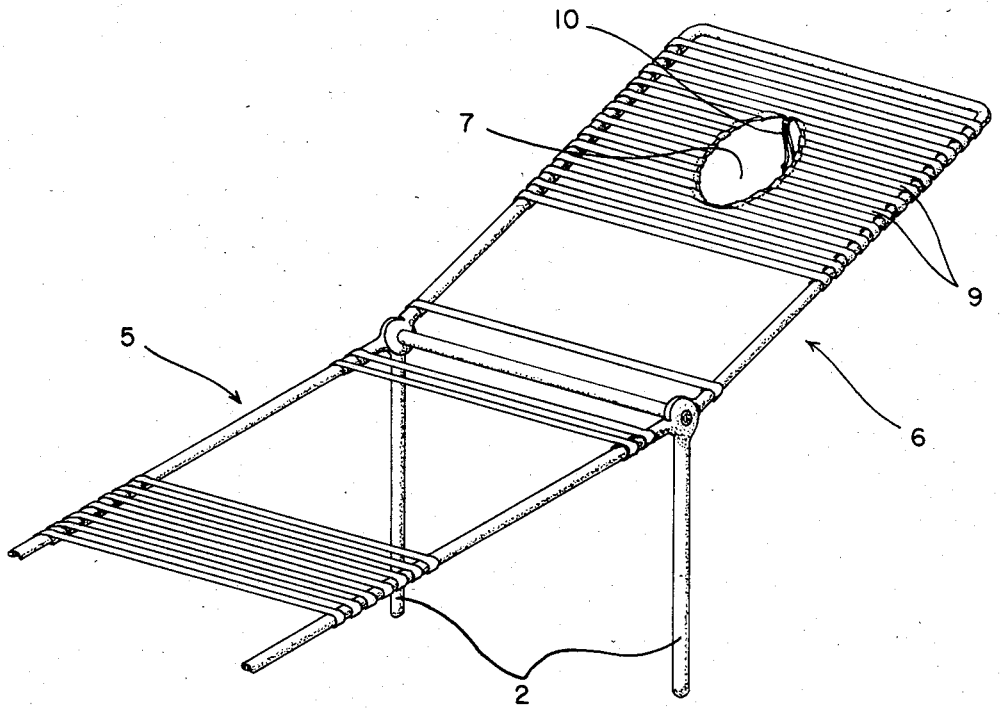
FIG. 3 is a partial three-dimensional view of the chair of the invention showing the upper body portion in a raised position and part of the central portion, both portions being partially cross-strapped.

The present invention is an improvement in the construction of pool lounge chairs so as to provide an opening in the upper body support portion of the chairs to allow a user to read while lying on his or her stomach.

The pool lounge chair, numeral 1, of the present invention is an adaptation of the conventional lounge chair made from lightweight aluminum tubing. The chair has three sections or portions, numerals 4, 5, and 6, and is generally supported by two leg sections, numerals 2 and 3.

In the upper-body support portion, numeral 6, there is provided an opening, numeral 7. This opening is generally circular or elliptical in shape and is made smaller than the face of its user, but large enough to provide an unobstructed opening for the eyes, nose and mouth. The opening, numeral 7, is formed in whatever backing or webbing forms the cross-straps or cross-members of the chairs which form supports for the user's body. In the drawings the cross-straps, numeral 9, are made of plastic tubing wrapped around the aluminum frame. The opening, numeral 7, is formed by shortening selected cross-straps in the upper body support portion, numeral 6, of the chair, numeral 1. The shortened cross-straps have closed loops at the ends thereof forming the shape of the opening. In order to make the opening adjustable, a drawstring, numeral 10 is passed through the loops to be tied at the loose ends in a tight or loose manner, depending on the shape and size of the user's face.

In its completed form, the user, numeral 8, can lie on his or her stomach as shown in FIG. 1, and read through the opening with his or her head comfortably supported in a natural position.

Of course, the cross-support structure does not have to be formed from individual cross-straps, but may alternatively be formed from a unitary position of a lightweight solid or mesh material sewn or stitched around the frame structure. The support material for the upper body portion of the chair has the opening formed therein as an integral portion thereof. The opening in such case is generally non-adjustable. However, if the opening is made of an elastic type material, a drawstring may be stitched to the opening, much like the drawstring in a hooded sweatshirt, to enlarge or shrink the opening to the satisfaction of the user.

The chair of the present invention has the new dimension provided herein but is in no way adversely affected for all its former known uses. The opening, numeral 7, will in all cases be small enough not to adversely affect any of the other normal uses to which the chair may be put.

Having thus described my invention, I claim:

1. An improved pool lounge chair adjustable from a sitting to a prone position wherein a portion of said chair capable of supporting the upper body of a user has provided therein an adjustable opening to receive and support a person's face without obstruction of the user's eyes, nose and mouth, and wherein the said opening is made adjustable by use of a drawstring attached around said opening, the ends of said drawstring capable of being connected loosely or tightly to adjust to the size of the user's face.

2. The pool lounge chair of claim 1 wherein the opening is in a substantially circular or elliptical shape provided by shortened cross straps across said portion, wherein the ends of said cross straps forming the said opening have closed loops therein, and wherein said drawstring extends through each of said loops.

3. The pool lounge chair of claim 1 wherein said portion of said chair capable of supporting said upper body and having therein said opening is a lightweight solid fabric.

4. The pool lounge chair of claim 1 wherein said portion of said chair capable of supporting said upper body and having therein said opening is a lightweight mesh fabric.

* * * * *